US008590998B2

(12) United States Patent
Kawakami et al.

(10) Patent No.: US 8,590,998 B2
(45) Date of Patent: Nov. 26, 2013

(54) FLUID EJECTING APPARATUS AND FLUID RECEIVING METHOD

(75) Inventors: Takayuki Kawakami, Matsumoto (JP); Takato Hayashi, Minowa-machi (JP)

(73) Assignee: Seiko Epson Corporation, Tokyo (JP)

( * ) Notice: Subject to any disclaimer, the term of this patent is extended or adjusted under 35 U.S.C. 154(b) by 391 days.

(21) Appl. No.: 12/975,621

(22) Filed: Dec. 22, 2010

(65) Prior Publication Data

US 2011/0157270 A1 Jun. 30, 2011

(30) Foreign Application Priority Data

Dec. 25, 2009 (JP) ..... 2009-295642

(51) Int. Cl.
*B41J 29/38* (2006.01)

(52) U.S. Cl.
USPC ..... 347/16

(58) Field of Classification Search
USPC ..... 347/16
See application file for complete search history.

(56) References Cited

U.S. PATENT DOCUMENTS 5,557,307 A 9/1996 Paroff
5,847,674 A 12/1998 Paroff et al.
6,189,989 B1 2/2001 Hirabayashi et al.
7,562,961 B2 7/2009 Inoue
2005/0062797 A1* 3/2005 Kachi ..... 347/33
2005/0268769 A1 12/2005 Zager
2006/0066664 A1* 3/2006 Kachi et al. ..... 347/33
2006/0232624 A1* 10/2006 Inoue ..... 347/23
2010/0118084 A1 5/2010 Seshimo

FOREIGN PATENT DOCUMENTS

JP 2005-119284 5/2005

* cited by examiner

*Primary Examiner* — Uyen Chau N Le
*Assistant Examiner* — Hoang Tran
(74) *Attorney, Agent, or Firm* — Workman Nydegger

(57) ABSTRACT

Provided is a fluid ejecting apparatus including: a fluid ejecting head which includes nozzles ejecting a fluid; a receiving member which is capable of receiving the fluid ejected from the nozzles; a pair of support members which supports the receiving member so as to extend in a linear shape; and a support member movement unit which moves the support member between first and second positions so that the receiving member is located at a receiving position capable of receiving the fluid ejected from the nozzles at the first position, and the receiving member is located at a retreat position deviating from the receiving position at the second position, wherein the support member movement unit allows the pair of support members to reach the first position at different timings.

4 Claims, 5 Drawing Sheets

FLUID EJECTING APPARATUS AND FLUID RECEIVING METHOD

BACKGROUND

1. Technical Field

The present invention relates to a fluid ejecting apparatus such as an ink jet printer and a fluid receiving method.

2. Related Art

In general, an ink jet printer (hereinafter, simply referred to as a "printer") has been known as a fluid ejecting apparatus that ejects a fluid from a nozzle formed on a fluid ejecting head toward a target. In the printer, if ink (fluid) is not ejected for some time from a specific nozzle during a printing process, the ink in the nozzle is thickened or solidified, dust becomes attached to the nozzle, or bubbles become mixed with the ink in the nozzle, which may cause an erroneous ejecting of the ink. Therefore, generally, the printer performs a flushing process in which the ink is ejected from the nozzle on the basis of a control signal not involved with the printing process.

That is, for example, in a serial type printer designed to perform a printing process while a printing head scans the main scanning direction, the flushing process is performed in such a manner that the printing head moves to a position deviating from the printing area and the ink is ejected toward a flushing box directly disposed below the printing head. Further, in a line head type printer designed to use a large printing head corresponding to the width of the printing sheet, JP-A-2005-119284 discloses a configuration in which an absorbing member (a receiving member) is provided in a transportation belt used to transport a printing sheet and the ink is ejected to the absorbing member.

However, in the case of the printer disclosed in JP-A-2005-119284, the absorbing member needs to directly face the nozzle during the flushing process. For this reason, the flushing process cannot be performed when the printing process is performed on an elongated sheet such as a continuous sheet. Further, since the ink needs to be ejected to the absorbing member at a timing at which the absorbing member is disposed and transported between the printing sheets and faces the printing head, a problem arises in that constraints on the size or the transportation speed of the printing sheet occur. Furthermore, since the flushing process is performed on the planar absorbing member in the printer disclosed in JP-A-2005-119284, mist-like ink scatters due to wind pressure accompanying the ejection of the ink, raises concerns that the inside of the printer may be contaminated.

Therefore, a method has been proposed in which a linear absorbing member moves within an empty area formed between a printing sheet and the printing head to face a nozzle, and ink is ejected from the nozzle to the absorbing member stopping at the facing position, where the flushing process is performed intermittently within a short period of time.

However, when the absorbing member is formed as a linear shape, the area capable of receiving the ink in the absorbing member decreases more than that of the planar absorbing member. In addition, when the linear absorbing member moving within the empty area formed between the printing sheet and the printing head stops at the position facing the nozzle, the linear absorbing member may be easily vibrated compared with the planar absorbing member.

For this reason, when the absorbing member is formed as a linear shape, since the absorbing member is vibrated, the absorbing member may deviate from the area capable of receiving the ink in the absorbing member, which raises concerns that the inside of the printer may be contaminated.

SUMMARY

An advantage of some aspects of the invention is that it provides a fluid ejecting apparatus capable of rapidly and easily receiving a fluid ejected from a nozzle to a receiving member even when the linear receiving member moves and stops at a position capable of receiving the fluid ejected from the nozzle, and a fluid receiving method.

According to an aspect of the invention, there is provided a fluid ejecting apparatus including: a fluid ejecting head which includes nozzles ejecting a fluid; a receiving member which is capable of receiving the fluid ejected from the nozzles; a pair of support members which supports the receiving member so as to extend in a linear shape; and a support member movement unit which moves the support member between first and second positions so that the receiving member is located at a receiving position capable of receiving the fluid ejected from the nozzles at the first position, and the receiving member is located at a retreat position deviating from the receiving position at the second position, wherein the support member movement unit allows the pair of support members to reach the first position at different timings.

When the support member moving from the second position to the first position stops at the first position, the linear receiving member supported by the support member may be vibrated at the receiving position due to the restoration force of the receiving member and the inertia force in the movement direction. For this reason, according to this configuration, since the support member movement unit allows the pair of support members to reach the first position at different timings, the waves having different phases in the receiving member is offset. Accordingly, when the linear receiving members move and stop at the receiving position where the ink ejected from the nozzles can be absorbed, it is possible to rapidly and easily receive the ink ejected from the nozzles by the use of the receiving members.

The fluid ejecting apparatus further includes a tensile force adjusting unit which adjusts a tensile force applied to the receiving member when the relative distance between the support members changes in accordance with the movement of the pair of support members.

When the relative distance between the supply members supporting the receiving member changes, the tensile force applied to the receiving member changes. That is, for example, when the relative distance between the support members increases, there is a concern that the tensile force applied to the receiving member may increase to thereby damage the receiving member. Further, when the relative distance between the supply members decreases, there is a concern that the receiving member may become loosened and is not located at the receiving position. For this reason, according to this configuration, since the tensile force adjusting unit adjusts the tensile force applied to the receiving member, it is possible to locate the receiving member at the receiving position while suppressing the damage thereof.

In the fluid ejecting apparatus, the support member movement unit starts the movement of the support members at different timings.

According to this configuration, since the support member movement unit starts the movement of the support members from the second position to the first position at different timings, it is possible to easily deviate the timings at which the support members reach the first position.

In the fluid ejecting apparatus, the support member movement unit moves the support members from the second position to the first position at different movement speeds.

According to this configuration, since the support member movement unit makes the movement speeds of the support members different upon moving the support members from the second position to the first position, it is possible to easily deviate the timings at which the support members reach the first position.

According to another aspect of the invention, there is provided a fluid receiving method in which a linear receiving member capable of receiving a fluid ejected from nozzles is supported by a pair of support members to extend in a linear shape, and the support members move between first and second positions so that the receiving member is located at a receiving position capable of receiving the fluid ejected from the nozzles at the first position, and the receiving member is located at a retreat position deviating from the receiving position at the second position, the fluid receiving method including: firstly allowing a first support member of the pair of support members to reach the first position at a first timing; and secondly allowing a second support member to reach the first position at a second timing different from the first timing.

According to this configuration, it is possible to obtain the same advantages as that of the above fluid ejecting apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment will be described with reference to the accompanying drawings, in which a fluid ejecting apparatus of the invention is embodied as an ink jet printer. Further, in the description below, the "longitudinal direction", the "horizontal direction", and the "vertical direction" respectively indicate the longitudinal direction, the horizontal direction, and the vertical direction depicted by the arrows in FIGS. 1 and 2.

Figure 1:
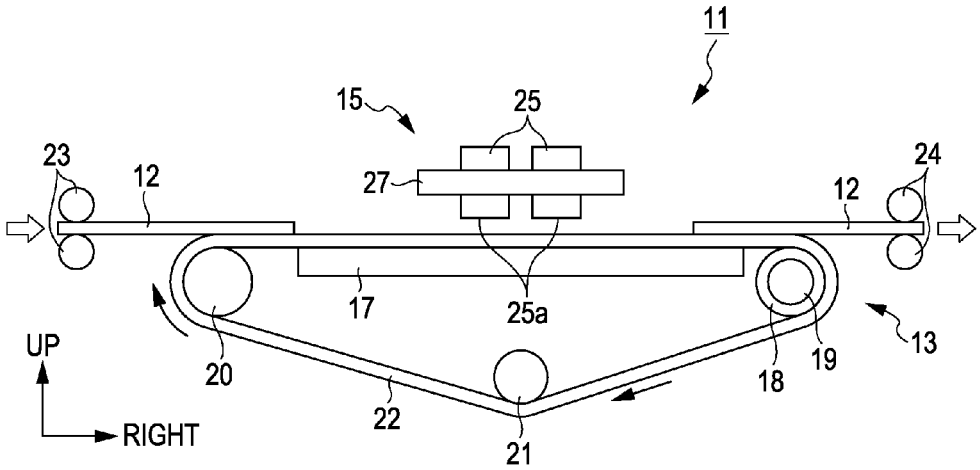
FIG. 1 is a front schematic diagram illustrating a printer of an embodiment.

As shown in FIG. 1, an ink jet printer (hereinafter, referred to as a "printer") 11 as a fluid ejecting apparatus includes a transportation unit 13 which transports a printing sheet 12 and a printing head unit 15 which performs a printing process on the printing sheet 12.

The transportation unit 13 includes a platen 17 which is formed as an elongated rectangular plate shape in the horizontal direction. A driving roller 18 extending in the longitudinal direction is disposed on the right side of the platen 17 so as to be rotationally driven by a driving motor 19, and a driven roller 20 extending in the longitudinal direction is disposed on the left side of the platen 17 so as to be rotatable. Further, a tension roller 21 extending in the longitudinal direction is disposed on the lower side of the platen 17 so as to be rotatable.

An endless transportation belt 22 having plural perforation holes (not shown) therein is wound on the driving roller 18, the driven roller 20, and the tension roller 21 so as to surround the platen 17. In this case, the tension roller 21 is biased downward by a spring member (not shown), and the looseness of the transportation belt 22 is suppressed by applying a tension to the transportation belt 22.

Then, if the driving roller 18 is rotationally driven in the clockwise direction when seen from the front side thereof, the transportation belt 22 moves along the outside portions of the driving roller 18, the tension roller 21, and the driven roller 20 when seen from the front side thereof. Further, when the printing sheet 12 is located to face the upper surface of the platen 17, the printing sheet 12 is drawn toward the platen 17 by a suction portion (not shown) over the transportation belt 22, and is transported from the left side as the upstream side to the right side as the downstream side.

Further, a pair of sheet feeding rollers 23 is provided on the obliquely left upper side of the driven roller 20 so as to sequentially feed each of the plurality of printing sheets 12 not subjected to the printing process onto the transportation belt 22. On the other hand, a pair of sheet discharging rollers 24 is provided on the obliquely right upper side of the driving roller 18 so as to discharge each of the printing sheets 12 subjected to the printing process from the transportation belt 22.

Figure 2:
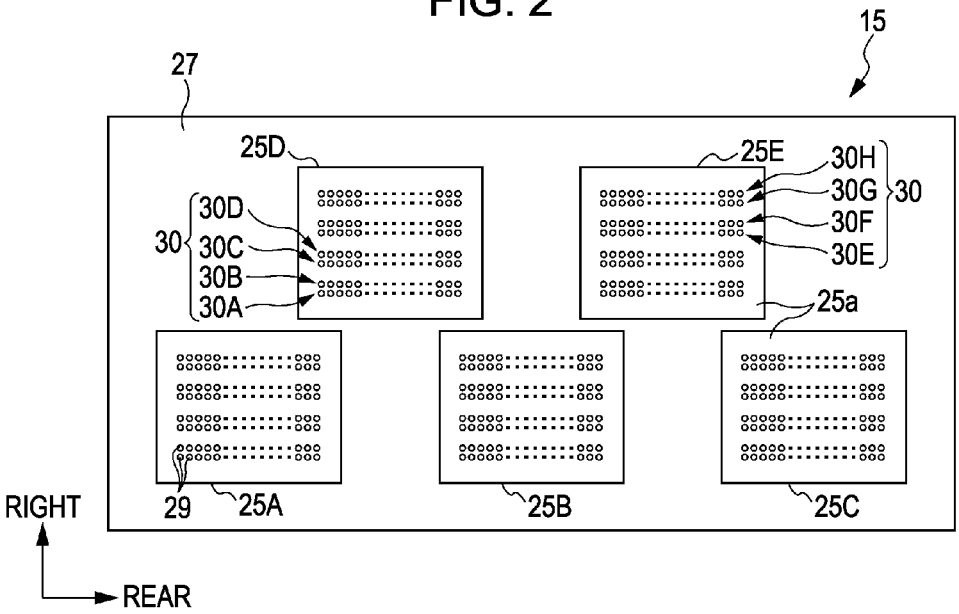
FIG. 2 is a schematic diagram illustrating a nozzle formation surface.

As shown in FIGS. 1 and 2, the printing head unit 15 has a configuration in which plural (in the embodiment, five) printing heads 25 (25A to 25E) as the fluid ejecting heads are disposed in a zigzag pattern in the width direction (the longitudinal direction) of the printing sheet 12 while being retained to a support plate 27. Then, a nozzle formation surface 25*a* formed on each of the lower surfaces of the printing heads 25 is provided with plural rows (in the embodiment, eight rows) of nozzle rows 30 (30A to 30H) which are regularly formed in the longitudinal direction with a predetermined pitch in the horizontal direction by plural nozzles 29. Further, the same kind of ink (fluid) is supplied to each pair of the nozzle rows 30 having the above-described configuration, and the ink is ejected from the nozzles 29.

That is, for example, black ink is supplied to the first and second nozzle rows 30A and 30B. Further, in the same way, cyan ink is supplied to third and fourth nozzle rows 30C and 30D, magenta ink is supplied to fifth and sixth nozzle rows 30E and 30F, and yellow ink is supplied to seventh and eighth nozzle rows 30G and 30H.

Figure 3:
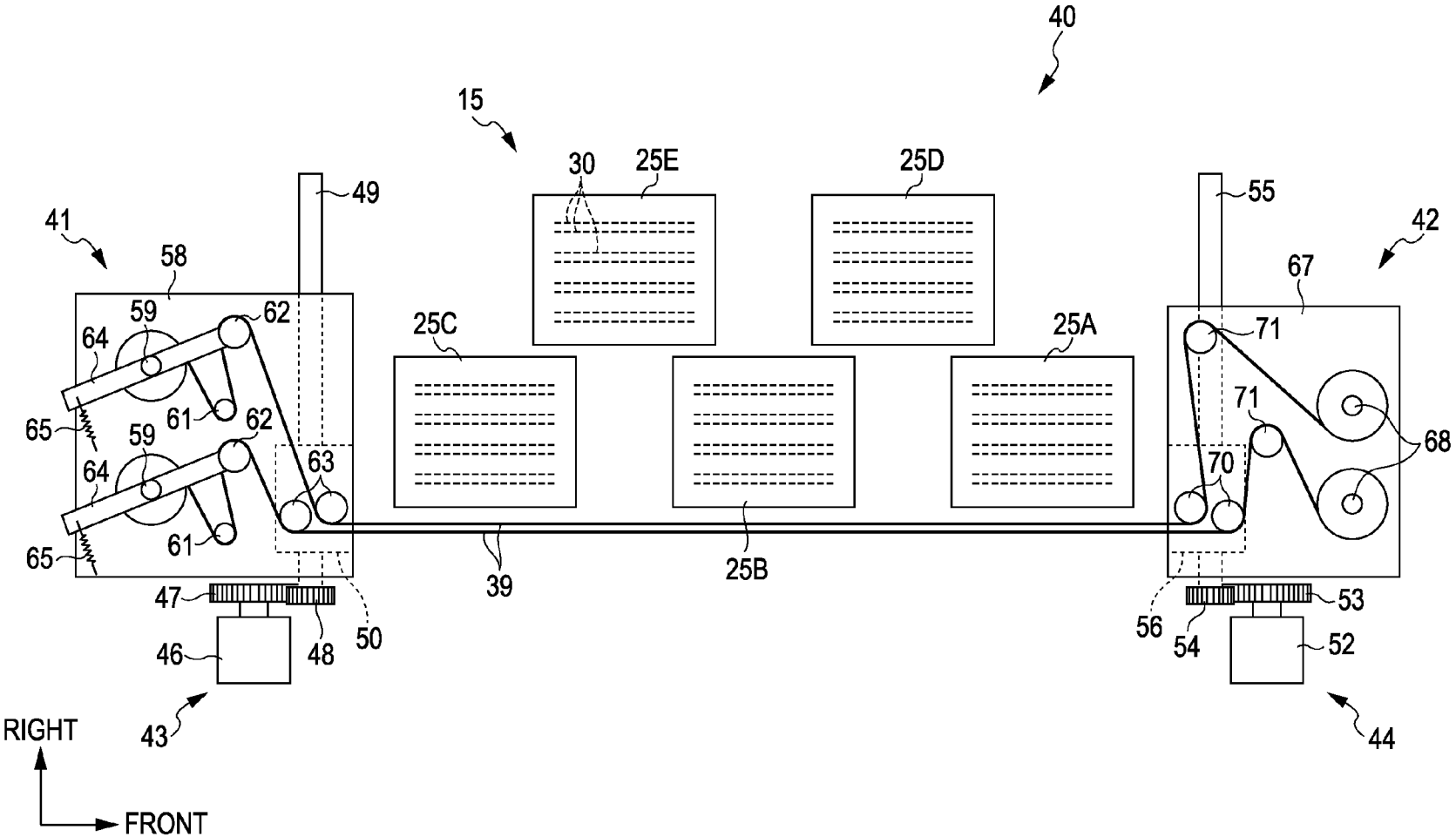
FIG. 3 is a schematic diagram illustrating a flushing unit that is located at a second position.

Further, as shown in FIG. 3, the printer 11 includes a flushing unit 40 which receives the ink (the fluid) ejected from the nozzles 29 by using a string member 39 as a linear receiving member during the flushing process.

The flushing unit 40 includes a supply portion 41 and a winding portion 42 which are provided with the printing head unit 15 interposed therebetween in the longitudinal direction, and support at least one (in the embodiment, two) string member 39 so as to be detachable therefrom. That is, the supply portion 41 and the winding portion 42 serve as support members that support the string member 39 as the receiving member so as to extend in a linear shape.

Then, the supply portion 41 and the winding portion 42 are adapted to be movable in a reciprocating manner in the horizontal direction using a pair of movement mechanisms 43 and 44 as members moving the support members. Therefore, both ends of the string member 39 are respectively supported by the supply portion 41 and the winding portion 42, and the string member 39 is movable in a reciprocating manner in the horizontal direction together with the supply portion 41 and the winding portion 42.

The first movement mechanism 43 includes a first driving gear 47 which is rotatable on the basis of a driving force of a first movement motor 46 and a first driven gear 48 which meshes with the first driving gear 47. A male screw is formed on an outer peripheral surface of a first shaft 49 that extends rightward from the center of the first driven gear 48, and a female screw hole formed in a first carriage 50 meshes with the male screw. Then, the supply portion 41 as a first support member is fixed to the first carriage 50. Therefore, when the first movement motor 46 is driven so as to rotate the first shaft 49, the supply portion 41 moves in a reciprocating manner in the horizontal direction together with the first carriage 50.

In the same way, the second movement mechanism 44 includes a second movement motor 52, a second driving gear 53, a second driven gear 54, a second shaft 55 attached with a male screw, and a second carriage 56 attached with a female screw hole. Then, when the second shaft 55 rotates on the basis of the driving force of the second movement motor 52, the winding portion 42 as a second support member fixed to the second carriage 56 moves in a reciprocating manner in the horizontal direction.

Here, the supply portion 41 includes a first stage 58 that is fixed to the first carriage 50. Then, a pair of winding shafts 59 is provided on the first stage 58 so as to be rotatable in accordance with the driving of a supply motor 60 (refer to FIG. 4), and first to third rollers 61 to 63 each formed as a pair are rotatably provided on the first stage 58. The string member 39 is rotatably wound on each of the winding shafts 59. Further, the string member 39 is sequentially wound on the first roller 61, the second roller 62, and the third roller 63, and is supplied from the supply portion 41.

Further, the second roller 62 is rotatably supported by a front end side of each of a pair of arms 64 that is tiltable about the center of the winding shaft 59. On the other hand, a tension spring 65 is provided on the rear end side of the arm 64 so as to apply a tensile force to the string member 39.

On the other hand, the winding portion 42 includes a second stage 67 which is fixed to the second carriage 56. Then, a pair of winding shafts 68 is provided on the second stage 67 so as to be rotatable in accordance with the driving of a collection motor 69 (refer to FIG. 4), and fourth and fifth rollers 70 and 71 each formed as a pair are rotatably provided on the second stage 67. Then, the pair of string members 39 supplied from the supply portion 41 are sequentially and respectively wound on the fourth and fifth rollers 70 and 71, and are wound on the winding shafts 68.

Further, the pitch between a pair of third rollers 63 in the horizontal direction and the pitch between a pair of fourth rollers 70 in the horizontal direction are set to be equal to that of the nozzle rows 30 in the horizontal direction. That is, in the embodiment, the pitch between the pair of string members 39 in the horizontal direction is equal to the pitch between the nozzle rows (for example, the first nozzle row 30A and the second nozzle row 30B) ejecting the same ink in the horizontal direction.

Furthermore, the diameter (the thickness) of the string member 39 is set to be smaller than the gap between the nozzle formation surface 25*a* and the printing sheet 12, and to be larger than the diameter of the nozzle 29. That is, for example, when the gap between the printing sheet 12 and the nozzle formation surface 25*a* of the printing head 25 is 2 mm and the diameter of the nozzle 29 is 0.02 mm, it is desirable that the diameter of the string member 39 be set to 0.2 to 1 mm (which is 10 to 50 times the diameter of the nozzle 29). When the diameter of the string member 39 is ten times the diameter of the nozzle 29, the ink can be received by the string member 39 even when the positional precision of the string member 39 and the nozzle 29 and manufacturing errors of the parts are counted in. In addition, when the diameter of the string member 39 is fifty times the diameter of the nozzle 29, the string member 39 can pass through a space area formed between the nozzle formation surface 25*a* and the printing sheet 12.

Figure 4:
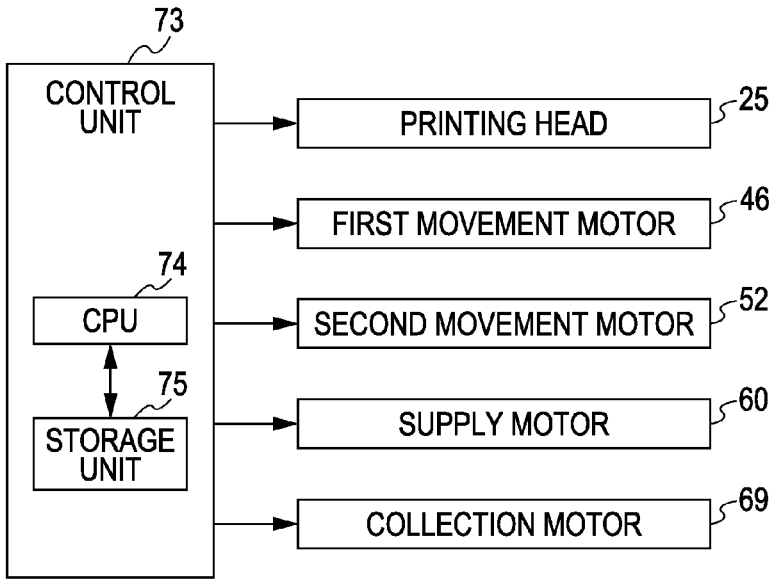
FIG. 4 is a block diagram illustrating a control unit.

Moreover, as shown in FIG. 4, the printer 11 includes a control unit 73 which generally controls the operation state of the printer 11. The control unit 73 is configured as a digital computer that includes a CPU 74 which serves as a central processing unit and conducts various calculations, and a storage unit 75 which stores various programs. Then, the CPU 74 controls the printing heads 25 on the basis of the programs stored in the storage unit 75 so as to control the ejection of the ink from each of the nozzles 29, and to control the driving of the first and second movement motors 46 and 52, the supply motor 60, and the collection motor 69.

That is, for example, when the control unit 73 drives the first and second movement motors 46 and 52 to be rotated in the normal direction, the supply portion 41 and the winding portion 42 move between first and second positions.

Figure 5:
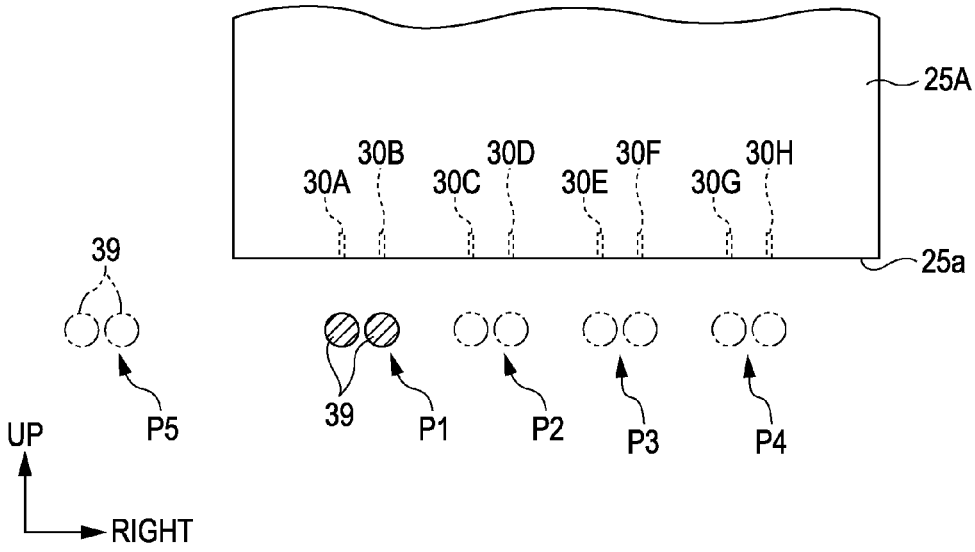
FIG. 5 is a front schematic diagram illustrating a printing head and describing a receiving position.
Figure 7:
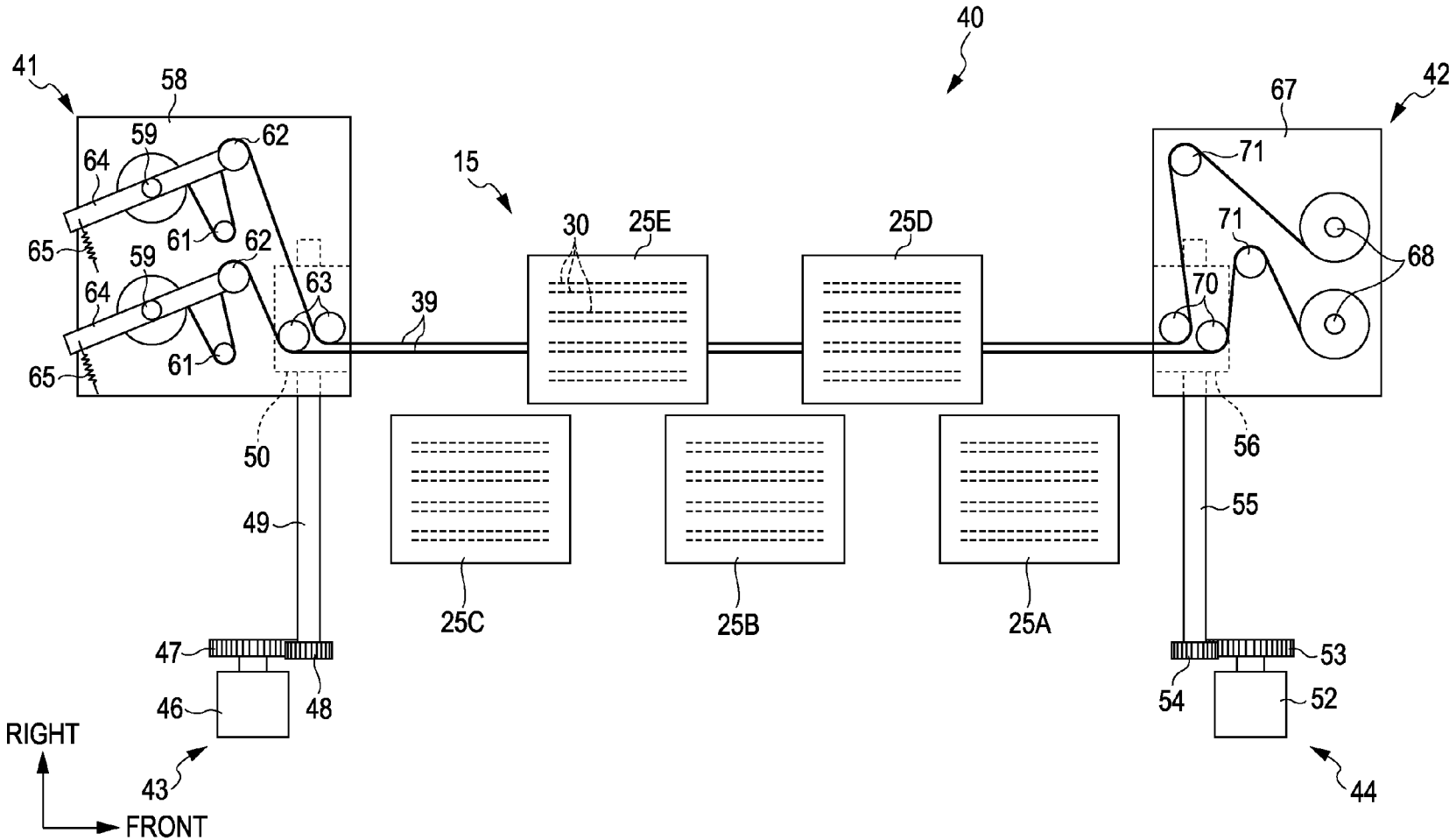
FIG. 7 is a schematic diagram illustrating the flushing unit that is located at the first position.

Further, as shown in FIGS. 5 and 7, the first position indicates a position in which each of the string members 39 faces each of the nozzle rows 30 in the vertical direction. That is, when the supply portion 41 and the winding portion 42 are located at the first position, the string member 39 is located at a position capable of receiving the ink ejected from the nozzle 29. Further, the first position and the receiving position are set in accordance with the number of the nozzle rows 30 and the string members 39, and in the embodiment, are set to eight positions (the number of the nozzle rows 30 located at different positions in the horizontal direction is divided by the number of the string members 39).

Specifically, as shown in FIG. 5, the position which is depicted by the solid line and in which the string members respectively face the first and second nozzle rows 30A and 30B of the first to third printing heads 25A to 25C disposed on the left side of the printing head unit 15 is set to a first receiving position P1. In the same way, the position in which the string members respectively face the third and fourth nozzle rows 30C and 30D is set to a second receiving position P2; the position in which the string members respectively face the fifth and sixth nozzle rows 30E and 30F is set to a third receiving position P3; and the position in which the string members respectively face the seventh and eighth nozzle rows 30G and 30H is set to a fourth receiving position P4.

Further, the positions in which the string members respectively face the first to eighth nozzle rows 30A to 30H of the fourth and fifth printing heads 25D and 25E disposed on the right side of the printing head 15 are set to fifth to eighth receiving positions (not shown). FIG. 7 shows a state in which the string members 39 are located at the sixth receiving position.

Then, when the control unit 73 drives the first and second movement motors 46 and 52 in the reverse direction while the supply portion 41 and the winding portion 42 are located at the first position, the supply portion 41 and the winding portion 42 move in the left direction so as to be located at the second position. Further, the second position indicates a position in which the string members 39 do not face the nozzle rows 30 in the vertical direction as shown in FIGS. 3 and 5. That is, when the supply portion 41 and the winding portion 42 are located at the second position, the string members 39 are located at a retreat position P5 that deviates from the first to fourth receiving positions P1 to P4 and the fifth to eighth receiving positions.

Next, the operation of the printer 11 with the above-described configuration and particularly the operation during the flushing process will be described below. Further, the supply portion 41 and the winding portion 42 are located at the second position at a timing other than the flushing process. That is, the string member 39 is located at the retreat position P5 at a timing other than the flushing process.

Here, when the printing process starts in the printer 11, the control unit 73 creates an ink ejecting timing for each of the nozzles 29 on the basis of the printing data, and ejects the ink on the basis of the ejection timing. Then, the printing process is performed on the printing sheet 12 supported and transported by the transportation belt 22.

However, when the period during which the ink is not ejected from the nozzle 29 is long, the viscosity inside the nozzle 29 increases, which raises concerns that ejection errors may occur. Therefore, the control unit 73 performs the flushing process, in which the ink is ejected at an ejection timing different from the timing of the printing process, every predetermined interval.

Specifically, the control unit 73 first moves the supply portion 41 in the right direction by driving the first movement motor 46 in the normal direction. In addition, the control unit 73 starts the driving of the second movement motor 52 in the normal direction at the timing different from the timing at which the driving of the first movement motor 46 in the normal direction starts. As a result, the winding portion 42 starts to move in the right direction at the timing different from the movement timing of the supply portion 41.

Figure 6:
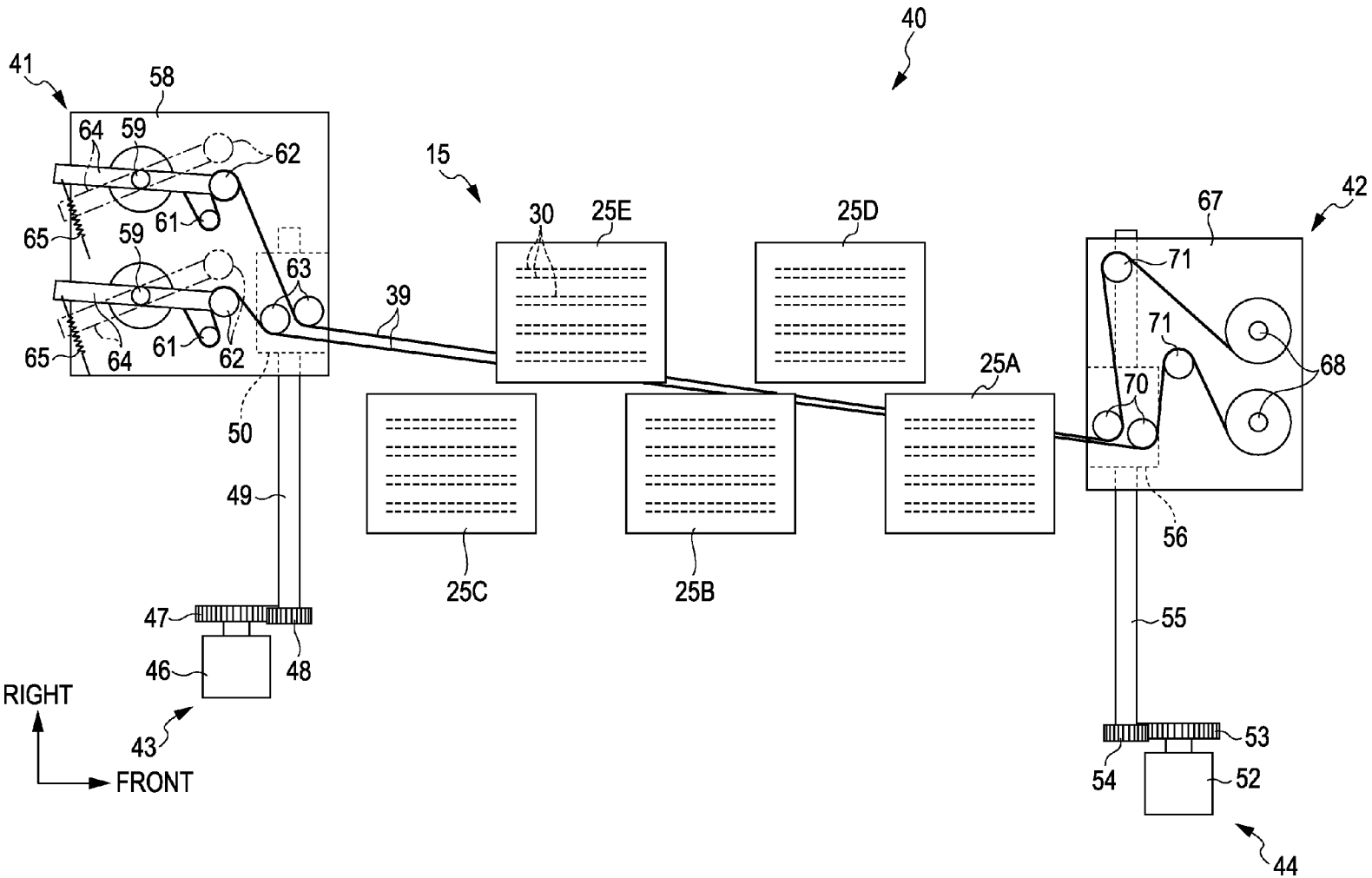
FIG. 6 is a schematic diagram illustrating the flushing unit moving from the second position to the first position.

Then, as shown in FIG. 3, among the supply portion 41 and the winding portion 42 located at the second position, the supply portion 41 first reaches the first position as shown in FIG. 6 (a first reaching procedure). Subsequently, the control unit 73 stops the driving of the first movement motor 46 so that the supply portion 41 is located at the first position.

Further, as shown in FIG. 7, the winding portion 42 started to move at the later timing reaches the first position at a second timing later than the first timing at which the supply portion reaches the first position (a second reaching procedure). Subsequently, the control unit 73 stops the driving of the second movement motor 52 so that the winding portion 42 is located at the first position. That is, the control unit 73 stops the driving of the first and second movement motors 46 and 52 so that the string member 39 is located at the sixth receiving position corresponding to the third and fourth nozzle rows 30C and 30D subjected to the flushing process.

Further, the relative distance between the supply portion 41 and the winding portion 42 during the movement thereof becomes larger than the relative distance when both are located at the first position and the second position. However, even when the relative distance between the supply portion 41 and the winding portion 42 changes, the second roller 62 biased by the tension spring 65 displaces from the position depicted by the two-dot dashed line in FIG. 6 to the direction depicted by the solid line. For this reason, it is possible to suppress a concern that excessive tensile force may be applied to the string member 39. Accordingly, for this reason, the arm 64 and the tension spring 65 serve as tensile force adjusting unit.

Furthermore, the control unit 73 ejects the ink from the third and fourth nozzle rows 30C and 30D by controlling the fourth and fifth printing heads 25D and 25E. In addition, the vibration of the string member 39 is suppressed when the string member 39 reaches the sixth receiving position. For this reason, the ink ejected from the third and fourth nozzle rows 30C and 30D is received in the string member 39 located below the third and fourth nozzle rows 30C and 30D.

Subsequently, the control unit 73 moves the supply portion 41 and the winding portion 42 located at the first position in the left direction so as to be located at the second position by driving the first and second movement motors 46 and 52 in the reverse direction. For this reason, the string members 39 located at the first receiving position P1 move to the retreat position P5.

In addition, the control unit 73 drives the supply motor 60 and the collection motor 69 in the normal direction so as to wind the ink receiving portion of the string member 39 on the winding shaft 68, and to supply the new string member 39 from the winding shaft 59. That is, the string member 39 not having the ink absorbed thereto is suspended between the supply portion 41 and the winding portion 42.

Further, when the flushing process is performed on all nozzle rows 30, the control unit 73 drives the first and second movement motors 46 and 52 in the normal direction at different timings while the supply portion 41 and the winding portion 42 are located at the second position. Then, the control unit 73 stops the driving of the first and second movement motors 46 and 52 so that the string members 39 are located at the first receiving position P1 corresponding to the first and second nozzle rows 30A and 30B of the first to third printing heads 25A to 25C disposed on the left side of the printing head unit. Subsequently, the control unit 73 performs the flushing process by ejecting the ink from the first and second nozzle rows 30A and 30B.

Subsequently, the control unit 73 further drives the first movement motor 46 in the normal direction from the state where the string members 39 are located at the first receiving position P1, and stops the driving of the first movement motor 46 so that the supply portion 41 is located at the first position corresponding to the third and fourth nozzle rows 30C and 30D.

Further, when the control unit 73 stops the driving of the first movement motor 46, the control unit 73 drives the second movement motor 52 in the normal direction, and stops the driving of the second movement motor 52 so that the winding portion 42 is located at the second position corresponding to the third and fourth nozzle rows 30C and 30D. Then, the control unit 73 ejects the ink from the third and fourth nozzle rows 30C and 30D by controlling the first to third printing heads 25A to 25C. Then, the ink is received in the string members 39 located below the third and fourth nozzle rows 30C and 30D while the vibration thereof is suppressed.

In the same way, the control unit 73 controls the driving of the first and second movement motors 46 and 52 so as to sequentially locate the string members 39 to the third and fourth receiving positions P3 and P4 and the fifth to eighth receiving positions. Then, the control unit 73 performs the flushing process by controlling the printing head 25 so as to eject the ink from the nozzle rows 30 facing the string members 39.

When the flushing process is performed on all nozzle rows 30, the control unit 73 drives the first and second movement motors 46 and 52 in the reverse direction so as to move the supply portion 41 and the winding portion 42 to the second position, and to locate the string members 39 at the retreat position P5.

According to the above-described embodiment, it is possible to obtain the advantages below.

(1) When the supply portion 41 and the winding portion 42 moving from the second position to the first position stop at the first position, the linear string members 39 supported by the supply portion 41 and the winding portion 42 may vibrated at the receiving position due to the restoration force of the string members 39 and the inertia force in the movement direction. For this reason, since the first and second movement motors 43 and 44 allow the supply portion 41 and the winding portion 42 to reach the first position at the different timings, the waves having different phases in the string members 39 are offset. Accordingly, even when the linear string members 39 move and stop at the receiving position where the ink ejected from the nozzles 29 can be absorbed, it is possible to rapidly and easily receive the ink ejected from the nozzles 29 by the use of the string members 39.

(2) When the relative distance between the supply portion 41 and the winding portion 42 supporting the string members 39 changes, the tensile force applied to the string members 39 changes. That is, for example, when the relative distance between the support members increases, there is a concern that the tensile force applied to the string members 39 may increase to thereby damage the string members 39. Further, when the relative distance between the supply portion 41 and the winding portion 42 decreases, there is a concern that the string members 39 may become loosened and not be located at the receiving position. For this reason, since the arm 64 and the tension spring 65 adjust the tensile force applied to the string members 39, it is possible to locate the string members 39 at the receiving position while suppressing the damage thereof.

(3) Since the first and second movement mechanisms 43 and 44 starts the movement of the supply portion 41 and the winding portion 42 from the second position to the first position at the different timings, it is possible to easily deviate the timings at which the supply portion 41 and the winding portion 42 reach the first position.

(4) Since the string members 39 move in the space area formed between the nozzle formation surface 25*a* and the printing sheet 12, it is possible to perform the flushing process regardless of the transportation timing of the printing sheet 12. In addition, even when the printing process is performed on the elongated and continuous sheet continuously supplied, it is possible to perform the flushing process.

Further, the above-described embodiment may be modified as below.

The first and second movement mechanisms 43 and 44 may move the supply portion 41 and the winding portion 42 at different movement speeds. That is, for example, the pitches of the male screws formed on the outer peripheral surfaces of the first and second shafts 49 and 55 may be different. In addition, the number of gears of the first and second driving gears 47 and 53 or the first and second driven gears 48 and 54 may be different from each other. Further, the first and second movement motors 46 and 52 having different output performances may be used. Then, since the first and second movement mechanisms 43 and 44 make the movement speeds of the supply portion 41 and the winding portion 42 different upon moving the supply portion 41 and the winding portion 42 from the second position to the first position, it is possible to easily deviate the timings at which the supply portion 41 and the winding portion 42 reach the first position.

The second positions of the supply portion 41 and the winding portion 42 may be set so that the distances from the printing head 25 are different. That is, even when the first and second movement motors 46 and 52 are driven at the same timing, since the distance of the second position and the first position is different for the supply portion 41 and the winding portion 42, it is possible to easily deviate the timings at which the supply portion 41 and the winding portion 42 reach the first position.

First, the second movement motor 52 may be driven in the normal direction so as to start the movement of the winding portion 42 earlier than the supply portion 41.

The arm 64 and the tension spring 65 may not be provided. In addition, the control unit 73 may adjust the tensile force of the string members 39 by controlling the driving of at least one of the supply motor 60 and the collection motor 69. That is, the supply motor 60 or the collection motor 69 may serve as a tensile force adjusting unit.

The control unit 73 may set the timing of moving the supply portion 41 and the winding portion 42 in accordance with the elasticity of the string members 39. That is, as a difference in timing of starting the movements of the supply portion 41 and the winding portion 42 is wide, the relative distance between the supply portion 41 and the winding portion 42 increases. For this reason, it is possible to change the relative distance by using the string members 39 having excellent elasticity.

The tensile forces of the string members 39 may be adjusted at the same time in such a manner that the plurality of string members 39 is wound on one second roller 62 and the second roller 62 moves.

At the time when the first and second movement mechanisms move the supply portion 41 and the winding portion 42 from the second position to the first position, the supply portion 41 and the winding portion 42 may be located at the first position by changing the movement direction thereof after passing through the first position.

A cleaning mechanism for cleaning the string members 39 receiving the ink may be provided, and the flushing process may be performed by supplying the string members 39 wound on the winding portion 42 to the supply portion 41 again.

The retreat position P5 of the string members 39 may be set to the lower side of the transportation path of the printing sheet 12 at a position facing the nozzle formation surface 25*a* of the printing head 25 in the vertical direction. That is, since the ink ejected from the nozzle 29 takes the form of mist, if the string members 39 are located to be away from the nozzle formation surface 25*a*, the string member cannot receive the ink even when facing the nozzle row 30. Therefore, the string members 39 may move between the retreat position on the lower side of the transportation path of the printing sheet 12 and the receiving position on the upper side of the transportation path of the printing sheet 12. Further, in the printer capable of disposing the string members 39 on the lower side of the transportation path of the printing sheet 12, the printing sheet 12 may be transported by a sheet feeding roller 23 and a sheet discharging roller 24 without using the transportation belt 22. Further, a receiving opening or a receiving hole may be provided in the transportation belt 22 or the platen 17, and the string members 39 may be received therein. In addition, the string members 39 may not be provided throughout the longitudinal direction of the printing head unit 15, but may be provided throughout, for example, the width corresponding to each of the printing heads 25.

The control unit 73 deviates the timings at which the supply portion 41 and the winding portion 42 reach the first position only in the movement from the retreat position P5 to the receiving position P1, and makes the arrival timings between the receiving positions the same. That is, since the timings at which both ends of the string member 39 reach the first position are different, the string member 39 is located at the receiving position while the vibration thereof is suppressed. Further, since the distance between the receiving positions is shorter than the distance between the retreat position and each of the receiving positions, even when the string members 39 move between the receiving positions while vibrating, the vibration is rapidly attenuated compared with the case where the string members 39 move from the retreat position P5 to the receiving position.

The string members 39 may set to have a length that can be supported by the supply portion 41 and the winding portion 42, and may be supported by a pair of support members not having the supply function and the winding function so as to be movable in the horizontal direction.

The supply portion 41 and the winding portion 42 may be disposed in a fixed manner, and the third roller 63 and the fourth roller 70 may be adapted to be movable in the horizontal direction. That is, when the third roller 63 and the fourth roller 70 move in the right direction, the string members 39 also move in the right direction along with the third roller 63 and the fourth roller 70. In this case, the third roller 63 and the fourth roller 70 serve as a support member. In addition, as a support member movement mechanism for moving the third and fourth rollers 63 and 70, the supply portion 41, and the winding portion 42, a rack-and-pinion, a solenoid, a cam mechanism, and the like may be used.

The string members 39 may be formed of fiber such as silk or cotton, synthetic fiber such as polyamide (for example, nylon) or polyester, and metal such as stainless steel. That is, the string member may be formed of fiber such as PBO (poly-phenylene-benzobisoxazole, product name: Zylon), polyarylate, ultrahigh molecular weight polyethylene, aramid, or nylon applied with a hydrophobic coating, or compound fiber containing a plurality of these. More specifically, it is possible to form the string members 39 in such a manner that plural fiber bundles formed of the fiber or the compound fiber are twisted or bound. Then, when the string members 39 are formed by twisting the plural fiber bundles, it is possible to hold the ink even between the fiber bundles, and thus to increase the ink receiving amount. Further, the string members 39 may be formed of an elastic member such as rubber having excellent elasticity, and may be formed to have elasticity by forming the string member in, for example, a spiral shape. Further, the string members 39 may absorb the attached ink between the fibers, and also may receive the ink by surface tension or electrostatic force.

In the printing head unit 15, the plural printing heads 25 may not be arranged in a zigzag pattern, but one printing head may be provided to have a length corresponding to the width direction of the printing sheet 12. Further, the printer 11 is not limited to the line type, but may be a serial type printer or a lateral type printer equipped with the movable printing head 25. That is, the flushing process may be performed by moving the printing head 25 to the position of the flushing unit 40.

In the above-described embodiment, the fluid ejecting apparatus is embodied as the ink jet printer 11, but the invention may be applied to a fluid ejecting apparatus that ejects a fluid different from the ink. The invention may be applied to various fluid ejecting apparatuses that include a fluid ejecting head ejecting a minute amount of liquid droplets. In addition, the liquid droplets represent the fluid ejected from the fluid ejecting apparatus, and include a liquid having a particle shape, a tear shape, or a linear shape. Further, here, the fluid may be a material which can be ejected from the liquid ejecting apparatus. For example, the material may be in a liquid or gas state, and includes a liquid material such as sol or gel water having a high or low viscosity, a fluid material such as an inorganic solvent, an organic solvent, a liquid, a liquid resin, or liquid metal (metallic melt), and a material in which particles of a functional material having a solid material such as pigment or metal particles are dissolved, dispersed, or mixed with a solvent in addition to a fluid. In addition, ink or liquid crystals described in the above-described embodiment may be exemplified as a typical example of the fluid. Here, the ink indicates general water-based ink, oil-based ink, gel ink, or hot-melt ink which contains various fluid compositions. As a detailed example of the fluid ejecting apparatus, for example, a liquid crystal display, an EL (electro-luminance) display, a plane-emission display, a fluid ejecting apparatus for ejecting a fluid containing dispersed or melted materials such as an electrode material or a color material used to manufacture a color filter, a fluid ejecting apparatus for ejecting a biological organic material used to manufacture a biochip, a fluid ejecting apparatus for ejecting a fluid as a sample used as a precise pipette, a silkscreen printing apparatus, or a micro dispenser may be used. In addition, a fluid ejecting apparatus for ejecting lubricant from a pinpoint to a precise machine such as a watch or a camera, a fluid ejecting apparatus for ejecting a transparent resin liquid such as a UV-curing resin onto a substrate in order to form a minute hemispherical lens (optical lens) used for an optical transmission element or the like, or a fluid ejecting apparatus for ejecting an etching liquid such as an acid liquid or an alkali liquid in order to perform etching on a substrate or the like may be adopted. Further, the invention may be applied to any one of these fluid ejecting apparatuses.

The entire disclosure of Japanese Patent Application No. 2009-295642, filed Dec. 25, 2009 is expressly incorporated by reference herein.

What is claimed is:

1. A fluid ejecting apparatus comprising:

a fluid ejecting head which includes nozzles formed in a nozzle row for ejecting a fluid; a receiving member which is capable of receiving the fluid ejected from the nozzles; a pair of support members which supports the receiving member, a first support member positioned on a first side of the fluid ejecting head and a second support member positioned on a second side of the fluid ejecting head so that the receiving member is able to extend from one side of the nozzle row to the other side of the nozzle row; a support member movement unit which moves the support member between a first position and a second position so that the receiving member is located at a receiving position capable of receiving the fluid ejected from the nozzles at the first position, and the receiving member is located at a retreat position deviating from the receiving position at the second position; and a tensile force adjusting unit which adjusts a tensile force applied to the receiving member when the relative distance between the support members changes in accordance with the movement of the pair of support members, wherein the support member movement unit allows the pair of support members to reach the first position at different timings.

2. The fluid ejecting apparatus according to claim 1, wherein the support member movement unit starts the movement of the support members at different timings.

3. The fluid ejecting apparatus according to claim 1, wherein the support member movement unit moves the support members from the second position to the first position at different movement speeds.

4. A fluid receiving method in which a linear receiving member capable of receiving a fluid ejected from a fluid ejecting head which includes nozzles formed in a nozzle row is supported by a pair of support members, a first support member of the pair of support members positioned on a first side of the fluid ejecting head and a second support member of the pair of support members positioned on a second side of the fluid ejecting head so that the linear receiving member is able to extend from one side of the nozzle row to the other side of the nozzle row, and the pair of support members move between a first position and a second position so that the receiving member is located at a receiving position capable of receiving the fluid ejected from the nozzles at the first position, and the receiving member is located at a retreat position deviating from the receiving position at the second position, a tensile force adjusting unit adjusting a tensile force applied to the linear receiving member when a relative distance between the pair of support members changes in accordance with the movement of the pair of support members, the fluid receiving method comprising:

firstly allowing the first support member of the pair of support members to reach the first position at a first timing; and secondly allowing the second support member of the pair of support members to reach the first position at a second timing different from the first timing.

* * * * *